US006520148B2

(12) United States Patent
Yonezawa et al.

(10) Patent No.: US 6,520,148 B2
(45) Date of Patent: Feb. 18, 2003

(54) THROTTLE CONTROL APPARATUS AND METHOD FOR DIRECT-FUEL-INJECTION-TYPE INTERNAL COMBUSTION ENGINE

(75) Inventors: Koichi Yonezawa, Toyota (JP); Osamu Hosokawa, Toyota (JP); Jun Takahashi, Toyota (JP); Senji Kato, Nishikamo-gun (JP); Hirohisa Kishi, Nagoya (JP); Noboru Takagi, Toyota (JP); Takayuki Demura, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/837,207

(22) Filed: Apr. 19, 2001

(65) Prior Publication Data

US 2001/0032615 A1 Oct. 25, 2001

(30) Foreign Application Priority Data

Apr. 21, 2000 (JP) ..... 2000-120698

(51) Int. Cl.[7] ..... F02D 41/06
(52) U.S. Cl. ..... 123/399; 123/179.18; 123/295
(58) Field of Search ..... 123/339.23, 179.18, 123/399, 295, 305

(56) References Cited

U.S. PATENT DOCUMENTS 4,691,677 A * 9/1987 Hotate et al. ..... 123/399
5,915,362 A * 6/1999 Fuwa et al. ..... 123/491
6,029,622 A * 2/2000 Kadota et al. ..... 123/295
6,098,594 A * 8/2000 Kowatari et al. ..... 123/339

FOREIGN PATENT DOCUMENTS

JP A 8-312401 11/1996

* cited by examiner

*Primary Examiner*—Tony M. Argenbright
*Assistant Examiner*—Johnny H. Hoang
(74) *Attorney, Agent, or Firm*—Oliff & Berridge, PLC

(57) ABSTRACT

A direct-fuel-injection-type internal combustion engine is equipped with an injector for injecting fuel directly into a combustion chamber of a cylinder. A controller controls the degree of opening of a throttle valve for adjusting the amount of air drawn into the combustion chamber and sets the throttle valve to a closed valve state by setting the degree of opening of the throttle valve to a degree of opening that is on the closed valve side of a post-engine start target degree of opening, when the engine is to be started. After it is determined that a start of the engine has been accomplished, the controller opens the throttle valve by gradually increasing the degree of opening of the throttle valve from the degree of opening of the closed valve state to the post-engine start target degree of opening.

11 Claims, 5 Drawing Sheets

THROTTLE CONTROL APPARATUS AND METHOD FOR DIRECT-FUEL-INJECTION-TYPE INTERNAL COMBUSTION ENGINE

INCORPORATION BY REFERENCE

The disclosure of Japanese Patent Application No. 2000-120698 filed on Apr. 21, 2000 including the specification, drawings and abstract is incorporated herein by reference in its entirety.

BACKGROUND OF THE INVENTION

1. Field of Invention

The present invention relates to a throttle control apparatus and method for a direct-fuel-injection-type internal combustion engine that is applied to a direct-fuel-injection-type internal combustion engine in which fuel is directly injected into its cylinders and that controls the degree of opening of a throttle valve for adjusting the amount of air taken into the cylinders.

2. Description of Related Art

Direct-fuel-injection-type internal combustion engines in which fuel is injected directly into the cylinders are known. In this type of internal combustion engine, it is necessary to sufficiently raise the pressure of fuel (fuel pressure) so as to allow fuel injection when the in-cylinder pressure becomes high during the compression stroke. Therefore, in a direct-fuel-injection-type internal combustion engine, a fuel pressure needed for injection is achieved by a mechanical high-pressure fuel pump that is driven by the engine as described in, for example, Japanese Patent Application Laid-Open No. 8-312401.

In such a direct-fuel-injection-type internal combustion engine, however, if the combustion chamber temperature is low at the time of a start of the engine, the fuel injected may deposit on a combustion chamber wall surface. As a result, the amount of fuel that actually contributes to combustion may become insufficient and the state of combustion may deteriorate. Therefore, in order to compensate for such a fuel shortage, the amount of fuel injected is increased. However, at the time of starting the engine initially, the fuel pressure generated by the high-pressure fuel pump is low. As a result, the amount of fuel that can be injected is correspondingly limited, as described in the aforementioned literature. Therefore, at the time of starting the engine initially, the air-fuel ratio of mixture around ignition plugs is on the fuel-lean side and misfires occur, thereby impeding stable operation of the engine, for example, fluctuating engine revolution, or the like.

SUMMARY OF THE INVENTION

It is an object of the invention to provide a throttle control apparatus and method for a direct-fuel-injection-type internal combustion engine that is capable of operating the engine with high stability.

In accordance with a first aspect of the invention, a throttle control apparatus for a direct-fuel-injection-type internal combustion engine in which fuel is injected directly into a cylinder includes: a throttle valve for adjusting an amount of intake air drawn into the cylinder; and a controller that, when the engine is to be started, sets the throttle valve to a degree of opening that is on a closed valve side of a post-engine start target degree of opening. Further, it is preferable that when the engine is to be started, the controller may sets the throttle valve to a closed valve state, and when it is determined that a start of the engine has been accomplished, the controller may open the throttle valve by gradually increasing the degree of opening of the throttle valve from the degree of opening of the closed valve state to the post-engine start target degree of opening.

Therefore, at the time of starting the engine initially, when the temperature in the cylinder is low, the degree of opening of the throttle valve is set to a degree of opening that is on the closed valve side of the post-engine start target degree of opening, so that the throttle valve is set to the closed valve state and the pressure in the cylinder is kept low. As a result, the pressure difference between the fuel injection pressure and the pressure occurring in the cylinder becomes great, so that injected fuel is well atomized and the spraying of fuel is accelerated. Hence, the amount of fuel that does not spray but deposits on inner surfaces of the combustion chamber reduces, and the amount of fuel that actually contributes to combustion increases. Consequently, even in a situation where the amount of fuel injected cannot be sufficiently increased, it is possible to avoid the occurrence of a fuel-lean mixture around the ignition plug and therefore avoid occurrence of a misfire.

However, if the throttle valve is set to the closed valve state at the time of starting the engine initially, the degree of opening of the throttle valve, after the start of the engine has been accomplished, is changed from the degree of opening of the closed valve state to the post-engine start target degree of opening. If in this case, the degree of opening of the throttle valve is controlled simply in accordance with changes of the target degree of opening, the amount of intake air will temporarily increase so that the spraying of injected fuel will deteriorate. This incurs a danger of deterioration of the combustion state and therefore a danger of engine revolution fluctuations. According to the above-described construction, however, after it is determined that the start of the engine has been accomplished, the throttle valve is opened in such a manner that the degree of opening thereof is gradually increased from the degree of opening of the closed valve state to the post-engine start target degree of opening. Therefore, sharp changes in the amount of intake air are curbed, and fluctuations of engine revolution are reduced. Hence, this construction makes it possible to achieve stable operation of the direct-fuel-injection-type internal combustion engine at the time of starting the engine initially.

In the above-described aspect, the controller may determine that a start of the engine has been accomplished, on a condition that an engine revolution speed has exceeded a predetermined revolution speed.

According to this construction, the engine revolution speed is employed to appropriately determine that the start of the engine has been accomplished. This makes it possible to prevent the throttle valve from being held in the closed valve state longer than necessary, and makes it possible to appropriately increase the engine revolution speed.

Furthermore, in the above-described aspect, a predetermined revolution speed may be variably set in accordance with an engine temperature of the internal combustion engine.

The readiness of the spraying of injected fuel changes in accordance with the engine temperature. For example, the spraying of injected fuel deteriorates more greatly if the engine temperature is lower and the temperature of the cylinder peripheral wall and the piston top surface on which spray of fuel impinges is lower. Therefore, if the predetermined revolution speed is set to a relatively low revolution speed, an undesired event described below is likely, for example, when the engine temperature is very low. That is, it is likely that although the starting of the engine has not been appropriately accomplished, it will be determined that the start of the engine has been accomplished. In such a case, the amount of intake air will be increased so that the spraying of injected fuel will deteriorate, thus leading to a misfire. However, according to the above-described construction, the engine revolution speed criterion (the predetermined engine revolution speed), which is employed for the determination as to whether the start of the engine has been accomplished, is variably set in accordance with the engine temperature. Therefore, it becomes possible to properly determine that the start of the engine has been accomplished and to properly increase the engine revolution speed, independently of whether the engine temperature is high or low.

Still further, in the above-described aspect, the controller may gradually increase the degree of opening of the throttle valve from the degree of opening of the closed valve state to the post-engine start target degree of opening, after a predetermined delay time elapses and after it is determined that the start of the engine has been accomplished.

In multi-cylinder internal combustion engines, individual cylinders sequentially undergo the explosion stroke at intervals. In some cases, therefore, immediately after it is determined that the start of the engine has been accomplished, the combustion chamber temperature is yet to be sufficiently raised by combustion in one or more cylinders. Therefore, if the degree of opening of the throttle valve is increased to the post-engine start target degree of opening immediately after it is determined that the start of the engine has been accomplished, an undesired event may occur in which the amount of intake air is increased although the combustion chamber temperature has not been sufficiently raised in one or more cylinders. In such a case, the spraying of fuel may deteriorate and the combustion state may deteriorate.

According to the above-described construction, however, the throttle valve is opened after the elapse of a predetermined delay time following the determination that the start of the engine has been accomplished. This ensures that the amount of intake air will be increased after the temperature of the combustion chamber of each cylinder is raised without fail. Hence, the deterioration of the combustion state as mentioned above can be reduced.

Furthermore, in the above-described aspect of the invention, the controller, after a start of the engine has been accomplished, may open the throttle valve by gradually increasing the target degree of opening of the throttle valve in accordance with transition of at least one of an intake pipe negative pressure, an amount of intake air, and an engine revolution speed.

According to this construction, when the start of the engine has been accomplished, the throttle valve can be opened to the post-engine start target degree of opening in a manner that is more suitable to the normal engine operation state. Therefore, it becomes possible to further stabilize the operation of the direct-fuel-injection-type internal combustion engine at the time of starting the engine initially.

Another aspect of the invention involves a method of controlling the throttle valve.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DETAILED DESCRIPTION OF PREFERRED EMBODIMENTS

First Embodiment

A first embodiment of a throttle control apparatus for an internal combustion engine of the invention will be described in detail hereinafter with reference to FIGS. 1 to 3B.

Figure 1:
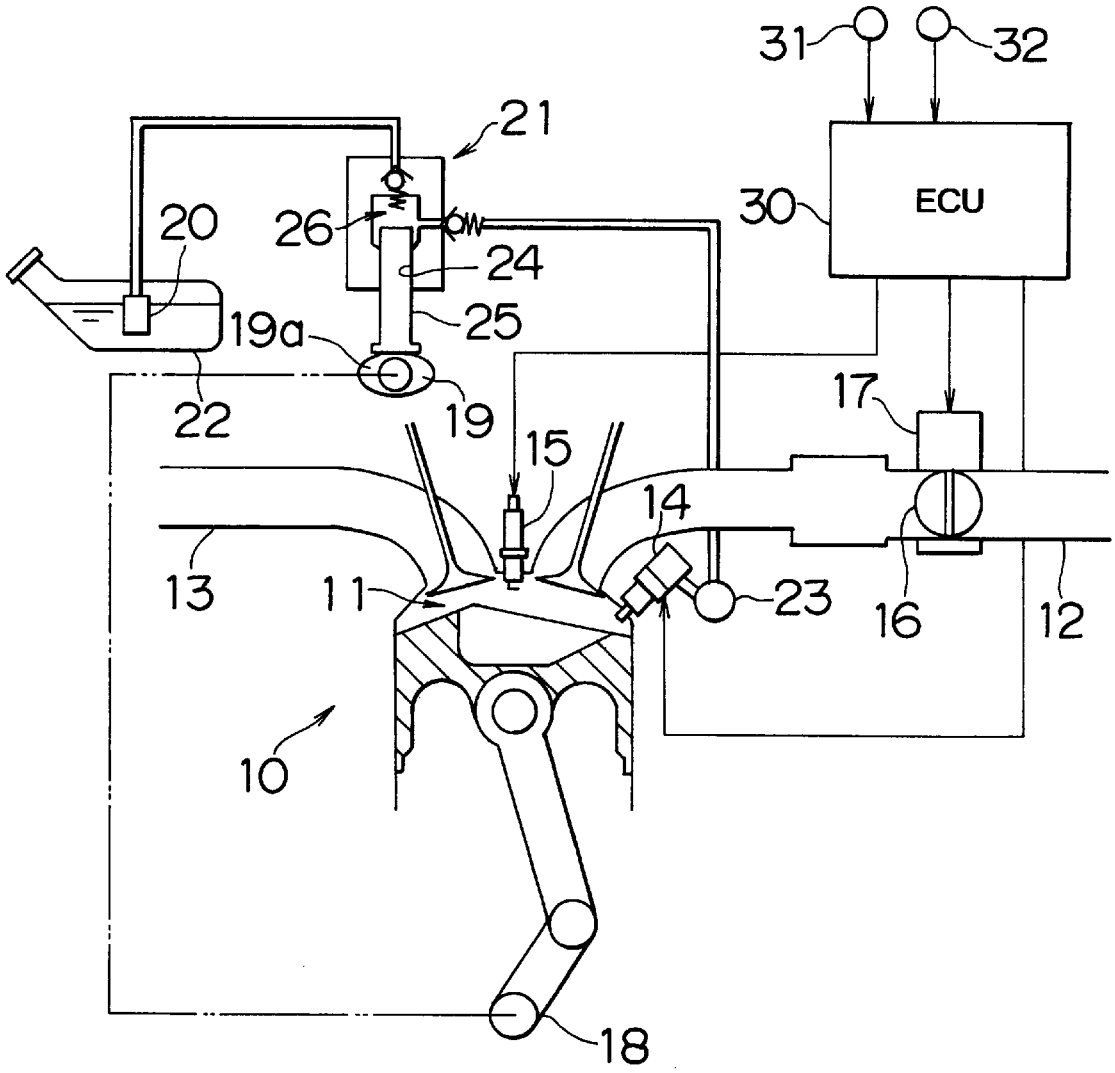
FIG. 1 is a schematic diagram illustrating an overall construction of a first embodiment of the invention.

Referring to FIG. 1, a direct-fuel-injection-type internal combustion engine has a combustion chamber 11, an intake passage 12 for delivering intake air into the combustion chamber 11, and an exhaust passage 13 for discharging exhaust from the combustion chamber 11. The combustion chamber 11 is provided with an injector 14 for injecting fuel directly into the cylinder, and an ignition plug 15 for igniting a mixture of fuel injected from the injector 14 and air drawn into the cylinder.

The intake passage 12 is provided with a throttle valve 16 for adjusting the amount of air taken into the cylinder via the intake passage 12. The throttle valve 16 is opened and closed by an electric motor 17 controlled by an electronic control unit (ECU) 30 that governs various controls of the internal combustion engine 10. The throttle valve 16 can be controlled to any degree of opening independently of the amount of depression of an accelerator pedal.

In the internal combustion engine 10, a fuel supplying system for supplying high-pressure fuel to the injector 14 has two fuel pumps: a low-pressure fuel pump 20, and a high-pressure fuel pump 21. The low-pressure fuel pump 20 is an electrically driven feed pump that draws fuel from a fuel tank 22 and feeds fuel to the high-pressure fuel pump 21.

The high-pressure fuel pump 21 has a cylinder 24, a plunger 25 provided for reciprocating movements within the cylinder 24, and a pressurizing chamber 26 defined by an inner peripheral wall of the cylinder 24 and a distal end surface of the plunger 25. The high-pressure fuel pump 21 is provided above a camshaft 19 that is drivingly connected to a crankshaft 18 of the internal combustion engine 10. The plunger 25 is reciprocated by pressing forces from a cam 19*a* provided on the camshaft 19. The high-pressure fuel pump 21 pressurizes fuel fed into the pressurizing chamber 26 from the low-pressure fuel pump 20 to a high pressure, in accordance with reciprocating movements of the plunger 25, and pumps pressurized fuel to a pressure accumulator pipe (delivery pipe) 23. Based on a command signal from the ECU 30, the injector 14, connected to the delivery pipe 23, injects pressurized fuel accumulated in the delivery pipe 23 into the combustion chamber 11.

The ECU 30 accepts inputs of signals outputted from various sensors and the like, for example, an NE sensor 31 for detecting the engine revolution speed NE, a water temperature sensor 32 for detecting the cooling water temperature thw, etc. In accordance with the state of operation of the internal combustion engine 10 based on signals from the sensors and the like, the ECU 30 performs various controls such as a control of the degree of opening of the throttle valve 16, a control of the injection timing of the injector 14, etc.

When the starting of the internal combustion engine 10 constructed as described above is initiated by turning an ignition switch (not shown) on, the crankshaft 18 is turned by a starter motor (not shown), that is, the internal combustion engine 10 is cranked by the starter motor. Upon completion of the initial explosion, the starting of the engine is accomplished. Then, at the time of establishment of a complete explosion state in which the internal combustion engine 10 autonomously and stably operates, the engine enters a normal operation.

Figure 2:
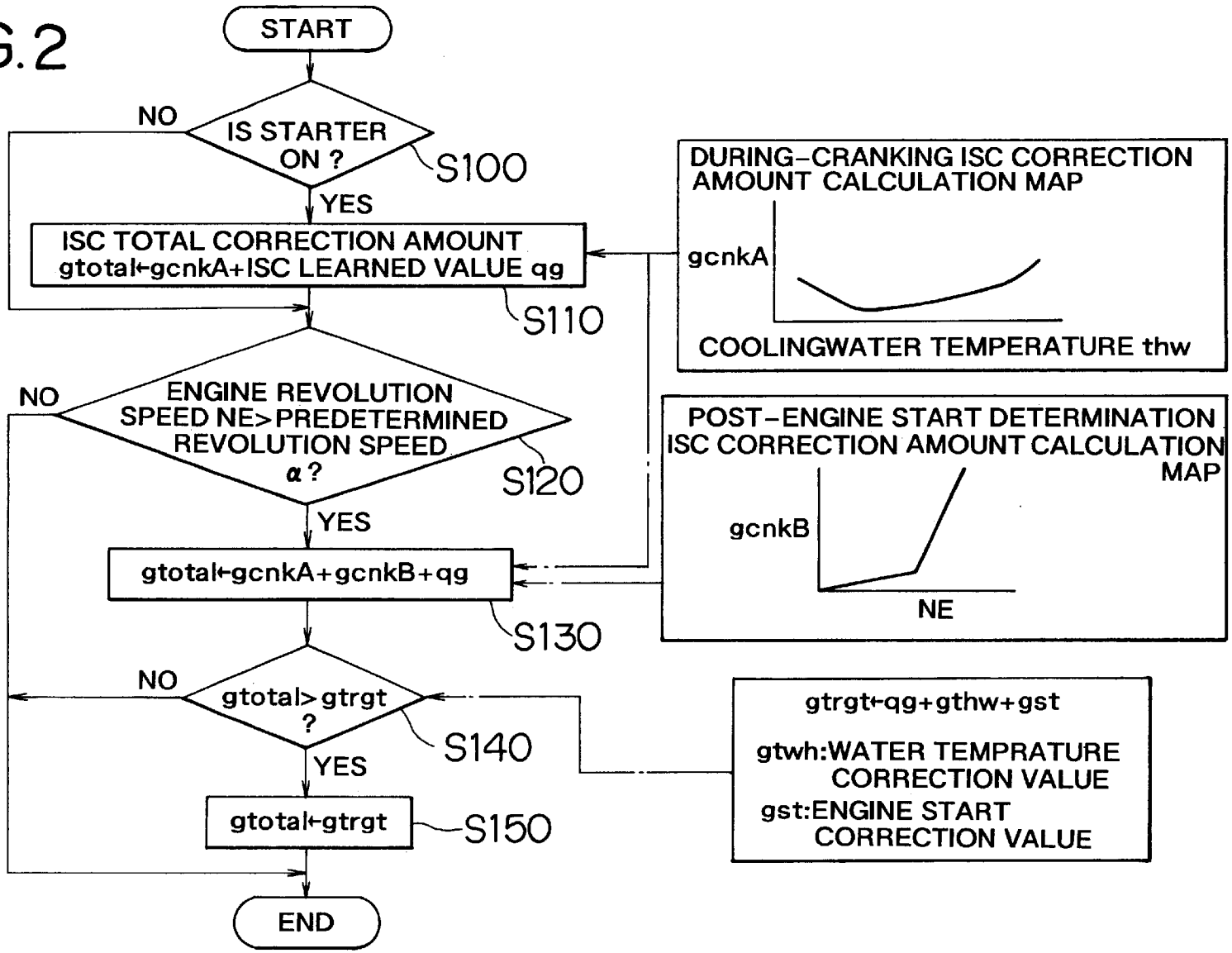
FIG. 2 is a flowchart illustrating a processing procedure related to the setting of the degree of opening of a throttle valve in the first embodiment.

FIG. 2 illustrates a processing procedure of the ECU 30 for calculating an idle speed control (ISC) total correction amount gtotal during the period between the initiation of the starting of the engine and the transition to the normal operation. The ISC total correction amount gtotal is one of the parameters used for calculating a target degree of opening of the throttle valve 16. The value of the ISC total correction amount gtotal is directly associated with the target degree of opening of the throttle valve 16 during the period between the initiation of the starting of the engine and the transition to the normal operation. That is, during that period, the value of the ISC total correction amount gtotal corresponds to the target degree of opening of the throttle valve 16. The series of processes in the routine illustrated by the flowchart of FIG. 2 is periodically executed by the ECU 30 during the aforementioned period.

When processing enters this routine, the ECU 30 first determines in step 100 whether the starter motor has been on. If the determination is negative ("N" at step 100), the ECU 30 immediately proceeds to step 120.

Conversely, if the determination is affirmative ("Y" at step 100), the ECU 30 calculates in step 110 an ISC total correction amount gtotal as in expression (a):

$$gtotal \leftarrow gcnkA + qg \quad (a)$$

In expression (a), gcnkA represents the ISC correction amount during cranking, and qg represents the ISC learned value.

The value of ISC correction amount gcnkA during cranking is calculated based on, for example, a calculation map provided in association with the cooling water temperature thw as shown in FIG. 2.

The ISC learned value qg is a correction value that is used to adjust the degree of opening of the throttle valve 16 during execution of an idle speed control for keeping the engine revolution speed at a predetermined idle speed. The ISC learned value qg is a learned value that is stored and updated while the ISC control is executed during an engine warm-up operation.

The ISC total correction amount gtotal determined by expression (a) is a value on a closed valve side of the target value gtrgt of the post-engine start ISC total correction amount (described below). That is, the target degree of opening of the throttle valve 16 based on the calculation result provided by expression (a) is a degree of opening on the closed valve side of the target degree of opening that is used after initial explosion has been completed and the starting of the engine has been accomplished.

Subsequently in step 120, the ECU 30 determines whether initial explosion has been completed and the starting of the engine has been accomplished. In this step, it is determined that the start of the engine has been accomplished, when the engine revolution speed NE is greater than a predetermined revolution speed $\alpha$. If the determination in this step is negative ("N"), the ECU 30 temporarily ends the process.

Conversely, if the determination in step 120 is affirmative ("Y"), that is, if it is determined that the starting of the engine has been accomplished, the ECU 30 subsequently determines in step 130 an ISC total correction amount gtotal based on expression (b):

$$gtotal \leftarrow gcnkA + gcnkB + qg \quad (b)$$

In expression (b), gcnkB represents the post-engine start determination ISC correction amount. The value of the post-engine start determination ISC correction amount is determined based on, for example, a calculation map provided in association with the engine revolution speed NE as shown in FIG. 2. The map is set so that the value of the post-engine start determination ISC correction amount increases with increases in the engine revolution speed. Therefore, the value of the calculation result provided by expression (b) shifts further toward the open valve side as the engine revolution speed NE increases.

Subsequently in step 140, it is determined whether the ISC total correction amount gtotal determined by the expression (b) is greater than the target value gtrgt of the post-engine start ISC total correction amount. The target value gtrgt of the post-engine start ISC total correction amount is determined by, for example, expression (c):

$$gtrgt \leftarrow qg + gthw + gst \quad (c)$$

In expression (c), gthw represents the water temperature correction value for the ISC total correction amount gtotal, and gst represents the engine start correction value.

During a cold engine operation prior to completion of a warm-up, the target degree of opening of the throttle valve 16 is corrected toward the open valve side to increase the amount of intake air, in order to increase the engine revolution speed and accelerate the temperature rise. The water temperature correction value gthw is a correction value used for such correction. The water temperature correction value gthw is set to a value further toward the open valve side if the cooling water temperature thw is lower.

Immediately after the starting of the engine is accomplished, the target degree of opening of the throttle valve 16 is corrected toward the open valve side to increase the amount of intake air, in order to stabilize the engine operation. The engine start correction value gst is a correction value used for such correction. The engine start correction value gst is set to a value that is further toward the open valve side if the engine revolution speed NE is lower. Furthermore, the engine start correction value gst is set so as to converge to zero in accordance with the elapsed time after the starting of the engine is accomplished.

If the calculation result of expression (b) is less than or equal to the post-engine start target value gtrgt and the determination in step 140 is negative, the ECU 30 sets the calculation result of expression (b) directly as an ISC total correction amount gtotal, and then temporarily ends the process. Conversely, if the calculation result of expression (b) is greater than the aforementioned target value gtrgt, the ECU 30 sets the target value gtrgt as an ISC total correction amount gtotal, and then temporarily ends the process.

Figures 3A, 3B:
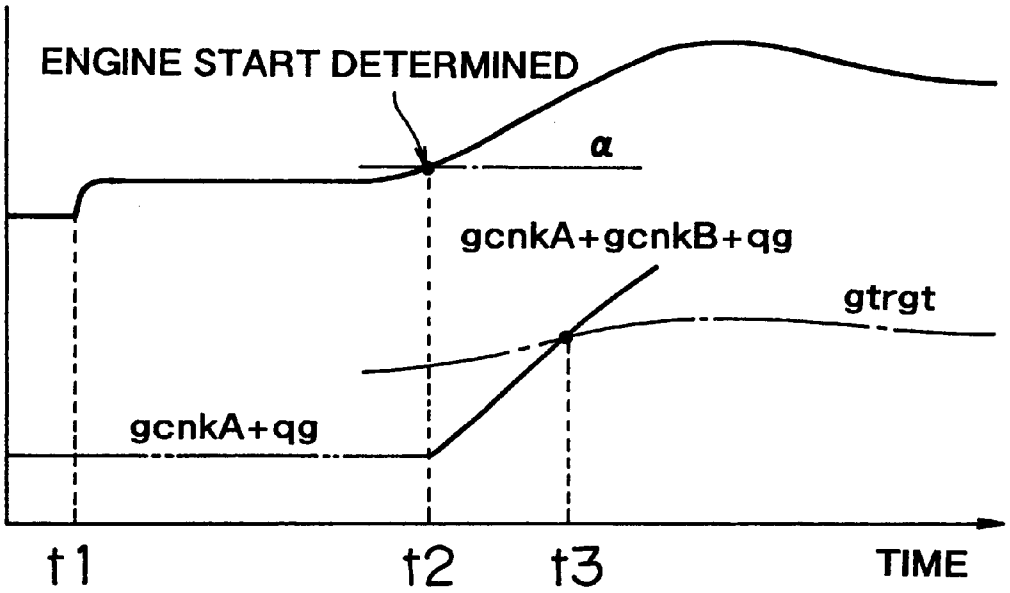
FIGS. 3A and 3B are diagrams indicating an exemplary manner of control in the first embodiment.

FIGS. 3A and 3B indicate an exemplary mode of the control in accordance with this embodiment. In the mode indicated in FIGS. 3A and 3B, cranking is performed at time point t1 to initiate starting of the engine initially. At time point t1, the starter motor is turned on ("Y" at step 100 in FIG. 2), and the engine revolution speed NE has not reached the predetermined revolution speed α, as can be seen in FIG. 3A. Thus, the start of the engine has not been accomplished ("N" at step 120 in FIG. 2). Therefore, the calculation result of expression (a), that is, the sum of the learned value qg and the ISC correction amount gcnkA during cranking, is set as a value of the ISC total correction amount gtotal, as indicated in FIG. 3B. The calculation result of expression (a) is a value on the closed valve side of the target value gtrgt of the post-engine start ISC total correction amount, as mentioned above. Therefore, the target degree of opening of the throttle valve 16 at time point t1 is set to a degree of opening on the closed valve side of the post-engine start target degree of opening, thus establishing a closed valve state.

After that, until the engine revolution speed NE reaches the predetermined revolutions speed α, the calculation result (gcnkA+qg) of expression (a) continues to be the value of the ISC total correction amount gtotal, and the throttle valve 16 is held in the aforementioned closed valve state, regardless of the on/off state of the starter motor.

In this case, the temperature in the combustion chamber 11 is low so that the fuel injected from the injector 14 does not readily spray. Furthermore, since the internal combustion engine 10 adopts the mechanical high-pressure fuel pump 21 as described above, it is difficult to secure a sufficient injection pressure immediately after the starting of the engine is initiated.

If, during this state, the throttle valve 16 is set to an open valve state and the pressure in the combustion chamber 11 is reduced, then the pressure difference between the fuel injection pressure and the pressure occurring in the combustion chamber 11 increases, so that the atomization of injected fuel is accelerated and the spraying of fuel is accelerated. As a result, the amount of fuel that does not spray but deposits on inner wall surfaces of the combustion chamber 11 reduces, and the amount of fuel that actually contributes to combustion increases. Therefore, it is possible to avoid the occurrence of a fuel-lean mixture around the ignition plug 15 and therefore to avoid a misfire, even in a situation in which the injection pressure cannot be sufficiently raised and the amount of fuel injected cannot be sufficiently increased.

Subsequently, at time point t2 when the engine revolution speed NE exceeds the predetermined revolution speed α and it is determined that the start of the engine has been accomplished ("Y" at step 120 in FIG. 2), the calculation result (gcnkA+gcnkB+qg) of expression (b) is set as a value of the ISC total correction amount gtotal. The value of the ISC total correction amount gtotal based on the calculation result of expression (b) gradually shifts toward the open valve side in accordance with increases in the engine revolution speed NE. Likewise, the target degree of opening of the throttle valve 16 is increased from the degree of opening of the closed valve state in accordance with increases in the engine revolution speed NE.

Then, as indicated in FIG. 3A, due to increases in the degree of opening of the throttle valve 16 and increases in the amount of intake air, the engine revolution speed NE increases. In response, the degree of opening of the throttle valve 16 is further increased. In this manner, after time point t2 when the starting of the engine is accomplished, the degree of opening of the throttle valve 16 is gradually increased from the degree of opening of the closed valve state, that is, the throttle valve 16 is gradually opened.

Subsequently, at time point t3, the calculation result of expression (b) exceeds the target value gtrgt of the post-engine start ISC total correction amount ("Y" at step 140). From that time point on, the value of the target value gtrgt is set as an ISC total correction amount gtotal. In this manner, the degree of opening of the throttle valve 16 is set to the post-engine start target degree of opening.

According to the embodiment described above, after the start of the engine is accomplished, the throttle valve 16 is opened by gradually increasing the degree of opening of the throttle valve 16 from the degree of opening of the closed valve state to the post-engine start target degree of opening. Therefore, sharp changes in the amount of intake air are curbed, and revolution fluctuations of the internal combustion engine 10 are reduced.

The above-described throttle control apparatus for a direct-fuel-injection-type internal combustion engine of this embodiment achieves the following advantages.

According to this embodiment, at the time of starting the engine initially, when the temperature in the combustion chamber 11 is low, the throttle valve 16 is set to a closed valve state by setting the degree of opening of the throttle valve 16 to a degree of opening that is on the closed valve side of the post-engine start target degree of opening. Therefore, the pressure in the combustion chamber 11 is kept low, so that the pressure difference between the fuel injection pressure and the pressure occurring in the combustion chamber 11 becomes great. Hence, the atomization of injected fuel is accelerated, and the spraying of fuel is promoted. As a result, the amount of fuel that does not spray but deposits on inner wall surfaces of the combustion chamber 11 reduces, and the amount of fuel that actually contributes to combustion increases. Consequently, it is possible to avoid the occurrence of misfires due to fuel-lean mixture around the ignition plug 15.

According to this embodiment, after it is determined that the start of the engine has been accomplished, the throttle valve 16 is opened by gradually increasing the degree of opening of the throttle valve 16 from the degree of opening of the aforementioned closed valve state to the post-engine start target degree of opening. Therefore, when the degree of opening of the throttle valve 16 is changed from the degree of opening of the closed valve state to the post-engine start target degree of opening, sharp changes in the amount of intake air are curbed, so that revolution fluctuations of the internal combustion engine 10 can be reduced.

According to this embodiment, it is determined that the start of the engine has been accomplished, on condition that the engine revolution speed NE exceeds the predetermined revolution speed a. The use of the engine revolution speed NE in the aforementioned determination makes it possible to appropriately determine that the starting of the engine has been accomplished. As a result, it becomes possible to prevent the throttle valve 16 from being held in the closed valve state longer than necessary and to appropriately increase the engine revolution speed NE.

According to the embodiment, after it is determined that the start of the engine has been accomplished, the degree of opening of the throttle valve 16 is gradually increased in accordance with transition of the engine revolution speed NE. Therefore, the throttle valve 16 is opened to the post-engine start target degree of opening in a manner that is more suitable to the engine operation state, so that the engine operation can be further stabilized.

According to the embodiment, the control of the degree of opening of the throttle valve 16 for the starting of the engine is applied to the internal combustion engine 10 employing the mechanical high-pressure fuel pump 21 that is driven in accordance with rotation of the crankshaft 18 so as to pressurize fuel to be injected. In an internal combustion engine 10 employing a mechanical high-pressure fuel pump 21, it is difficult to secure a sufficient fuel injection pressure at the time of a starting the engine initially. Correspondingly, the amount of fuel that can be injected at the time of starting the engine initially is limited. In such a case, therefore, although the amount of fuel actually contributing to combustion reduces due to the degraded spraying of injected fuel, it is often difficult to compensate for the reduction in the amount of fuel by increasing the amount of fuel injected. In the embodiment, however, degradation of the spraying of fuel is curbed by the control of the degree of opening of the throttle valve 16. Therefore, the embodiment allows the degradation of combustion to be appropriately curbed even in the internal combustion engine 10 equipped with the mechanical high-pressure fuel pump 21 wherein the amount of fuel injected cannot be sufficiently increased at the time of starting of the engine initially.

Second Embodiment

A second embodiment of the invention will next be described, mainly with regard to features different from those of the first embodiment.

In the first embodiment, the throttle valve 16 is set to a closed valve state at the time of starting the engine initially by setting the degree of opening of the throttle valve 16 to a degree of opening that is on the closed valve side of the post-engine start target degree of opening. After it is determined that the start of the engine has been accomplished, the throttle valve 16 is opened by gradually increasing the degree of opening of the throttle valve 16 from the degree of opening of the closed valve state to the post-engine start target degree of opening.

In multi-cylinder internal combustion engines, individual cylinders sequentially undergo the explosion stroke at intervals. In some cases, therefore, immediately after it is determined that the initial explosion has been completed and the initial starting of the engine has been accomplished, one or more cylinders have not undergone explosion, and do not have a sufficient temperature raise achieved by combustion in the combustion chambers. Therefore, if the degree of opening of the throttle valve 16 is increased to the post-engine start target degree of opening immediately after it is determined that the initial starting of the engine has been accomplished, an undesired event may occur in which the amount of intake air is increased although the combustion chamber temperature has not been sufficiently raised in one or more cylinders. In such a case, the spraying of fuel may deteriorate and the combustion state may deteriorate.

Figures 4A, 4B, 4C:
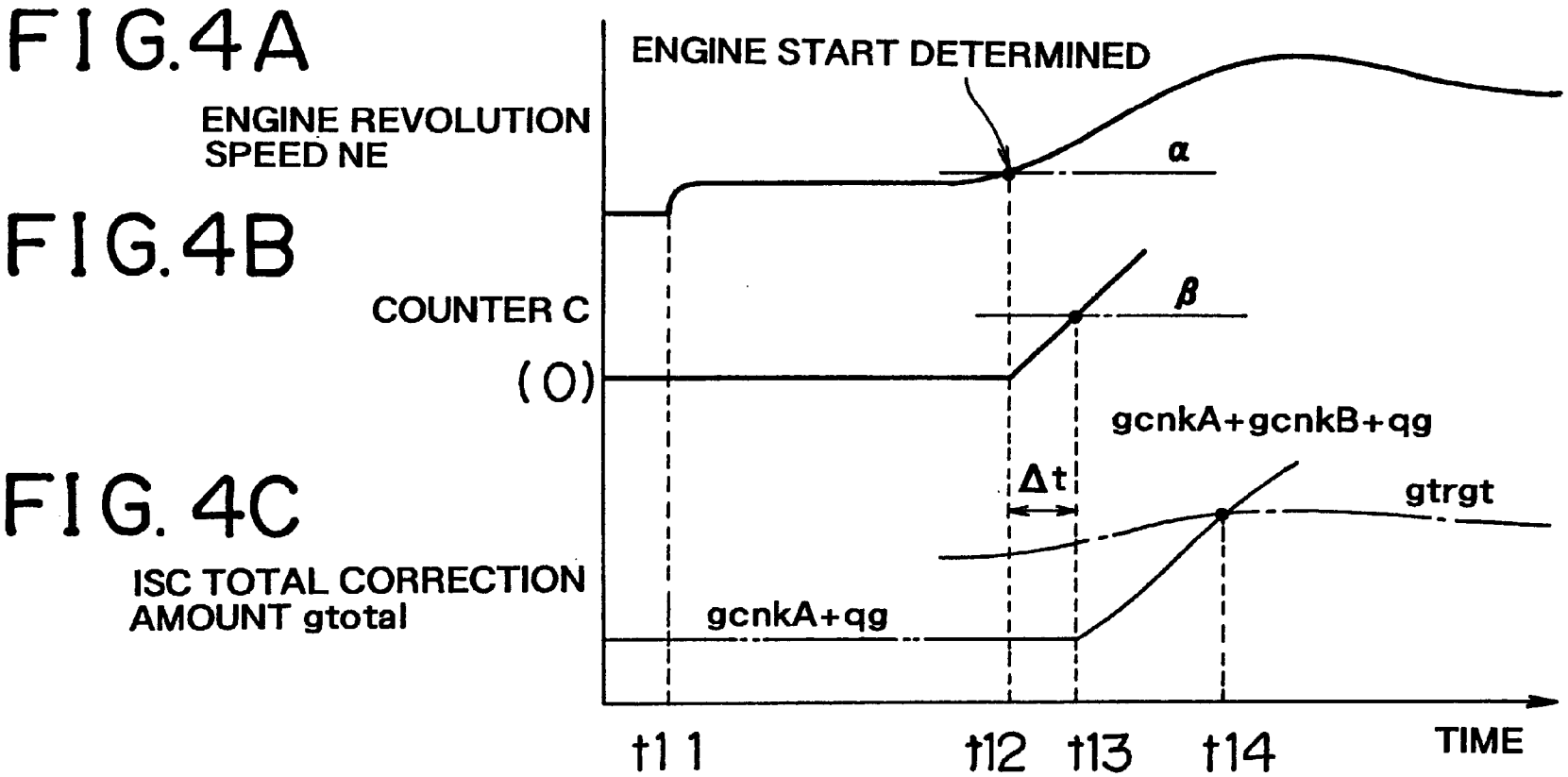
FIGS. 4A to 4C are diagrams indicating an exemplary manner of control in a second embodiment.

Therefore, in this embodiment, the closed valve state of the throttle valve 16 is maintained even after time point t12 when it is determined that the initial starting of the engine has been accomplished. More specifically, the driving of the throttle valve 16 from the closed valve state to an open valve state is delayed to time point t13, that is after the elapse of a predetermined time Δt following time point t12, as indicated in FIGS. 4A to 4C. Thus, the throttle valve 16 is opened after the temperature raise by combustion has been achieved in all the cylinders.

Figure 5:
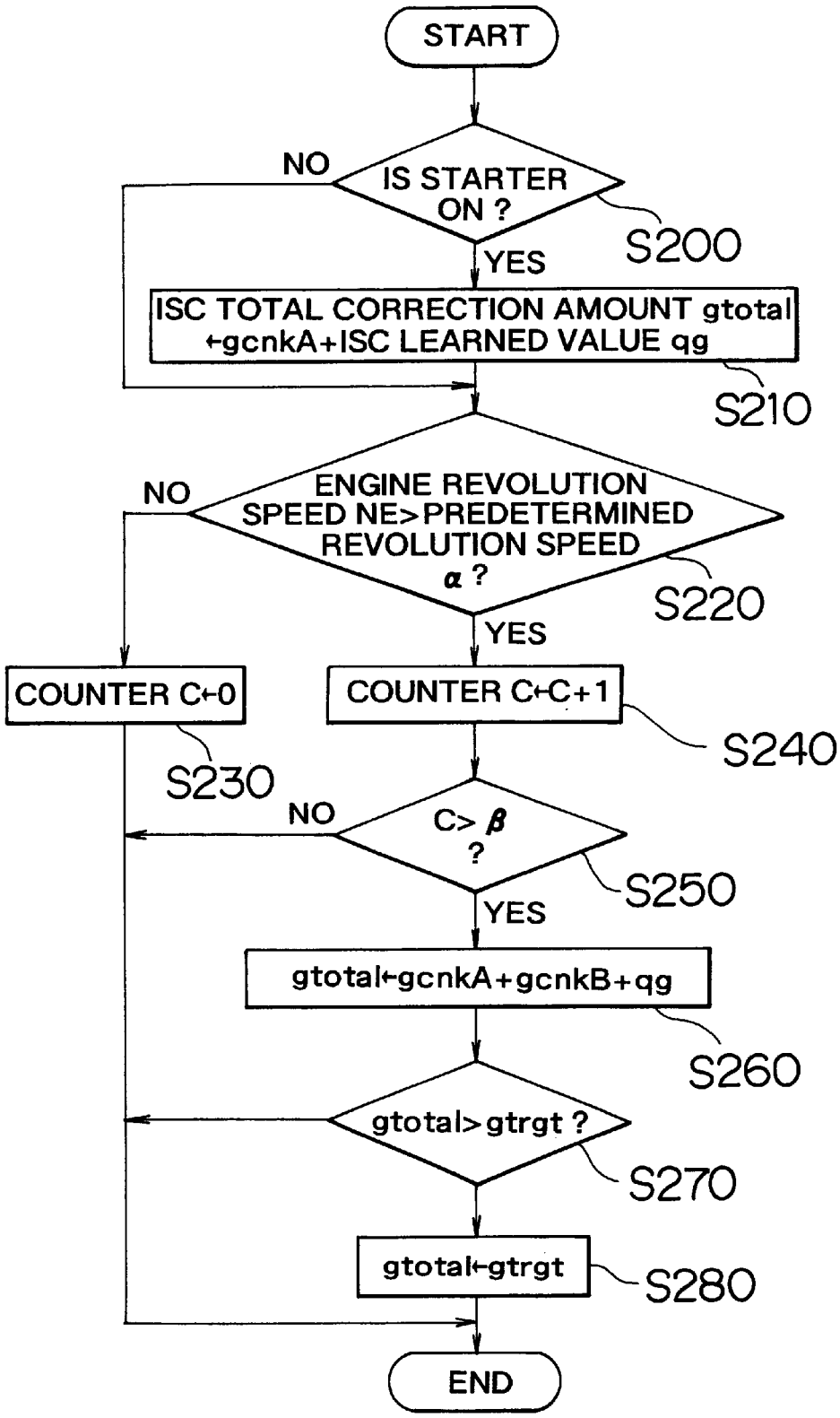
FIG. 5 is a flowchart illustrating a processing procedure related to the setting of the degree of opening of the throttle valve in the second embodiment.

FIG. 5 is a flowchart illustrating a processing procedure of the ECU 30 for calculating the ISC total correction amount gtotal at the time of the starting of the engine. A series of processes illustrated in this flowchart is periodically executed by the ECU 30 during the transition from the initiation of the starting of the engine to the normal engine operation, as in the case of the processes illustrated in the flowchart of FIG. 2.

When processing enters this routine, the ECU 30 first determines in step 200 whether the starter motor has been on. If the determination is affirmative ("Y"), the ECU 30 calculates in step 210 an ISC total correction amount gtotal based on expression (a), as in the case of the aforementioned process of step 110. Subsequently in step 220, the ECU 30 determines whether the initial explosion has been completed and the start of the engine has been accomplished. The processes up to this step are substantially the same as the processes of steps 100 to 120 in FIG. 2.

According to this embodiment, if the determination in step 220 is negative ("N"), the value of a counter C is set to zero in step 230. If the determination in step 220 is affirmative ("Y"), that is, if it is determined that the start of the engine has been accomplished, "1" is added to the value of the counter C in step 240. Therefore, the value of the counter C is held at zero until it is determined that the start of the engine has been accomplished. After such determination, the value of the counter C is incremented by "1" every time this routine is executed. That is, the value of the counter C corresponds to the time elapsing after it is determined that the start of the engine has been accomplished.

In step 250, subsequent to step 240, the ECU 30 determines whether the value of the counter C is greater than a predetermined value β. If the value of the counter C is not greater than the predetermined value β ("N"), the ECU 30 temporarily ends the processing of this routine while keeping the calculation result of expression (a) as the ISC total correction amount gtotal, although it has been determined that the start of the engine has been accomplished.

According to this embodiment, if it is determined in step 250 that the value of the counter C has exceeded the predetermined value β, the ECU 30 executes the process starting at step 260, which is substantially the same as the process starting at step 130 in FIG. 2. That is, in step 260, the ECU 30 calculates an ISC total correction amount gtotal based on expression (b). Subsequently, if it is determined in step 270 that the calculation result of expression (b) is not greater than the target value gtrgt of the post-engine start ISC total correction amount ("N"), the ECU 30 sets the calculation result as a value of the ISC total correction amount gtotal, and temporarily ends the processing of this routine. Conversely, if the calculation result of expression (b) is greater than the target value gtrgt of the post-engine start ISC total correction amount ("Y" at step 270), the ECU 30 sets the target value gtrgt as an ISC total correction amount gtotal in step 280, and temporarily ends the processing.

In this embodiment, the calculation result (gcnkA+qg) of expression (a) is set as a value of the ISC total correction amount gtotal and the throttle valve 16 is thus set to the closed valve state during a period between time point t11 when the starting of the engine is initiated and time point t12 when it is determined that the start of the engine has been accomplished as indicated in FIGS. 4A to 4C, as in the first embodiment.

In this embodiment, however, the value of the ISC total correction amount gtotal continues to be held at the calculation result of expression (a) even after time point t12 when it is determined that the start of the engine has been accomplished, as indicated in FIG. 4C. At time point t12, the counting with the counter C is started as indicated in FIG. 4B.

Then, at time point t13, the value of the counter C exceeds the predetermined value β. From this time point on, the calculation result (gcnkA+gcnkB+qg) is set as a value of the ISC total correction amount gtotal, so that the degree of opening of the throttle valve 16 is gradually increased from the degree of opening set during the closed valve state to the post-engine start target degree of opening. After that, at time point t14 when the calculation result of expression (b) exceeds the target value gtrgt of the post-engine start ISC total correction amount, the target value gtrgt is set as an ISC total correction amount gtotal, so that the degree of opening of the throttle valve 16 is set to the post-engine start target degree of opening.

In this manner, according to the second embodiment, at the time point t13 that is delayed for a predetermined time Δt from the time point t12 when it is determined that the start of the engine has been accomplished, the degree of opening of the throttle valve 16 starts to be gradually increased from the degree of opening of the closed valve state to the post-engine start target degree of opening. Therefore, the amount of intake air is increased after all the cylinders have undergone the explosion stroke and the temperature in the combustion chamber 11 of each cylinder has been raised by combustion without fail.

It is preferred that the predetermined delay time Δt be set to at least a length of time within which each cylinder undergoes combustion at least once. In this embodiment, the predetermined value β is set such that the predetermined delay time Δt becomes equal to a time corresponding to several cycles of the internal combustion engine 10, in order to ensure that all the cylinders undergo combustion after the initial explosion.

The above-described embodiment achieves the advantages as achieved by the first embodiment, and further achieves the following advantages.

According to this embodiment, at the elapse of the predetermined delay time Δt following the determination that the initial explosion has been completed and the start of the engine has been accomplished, the degree of opening of the throttle valve 16 starts to be gradually increased from the degree of opening of the closed valve state to the post-engine start target degree of opening. This allows the amount of intake air to be increased after each cylinder has undergone combustion and the temperature in the combustion chamber 11 of each cylinder has been raised without fail. Therefore, the embodiment substantially prevents an incident that although in some cylinders, the temperature in the combustion chamber 11 has not been sufficiently raised by combustion, the amount of intake air is increased, and therefore the spraying of fuel deteriorates and the combustion state deteriorates.

The above-described embodiments may be modified as follows.

In the foregoing embodiments, it is determined that the start of the engine has been accomplished provided that the engine revolution speed NE has exceeded the predetermined revolution speed α. The predetermined revolution speed α used for this determination may be variably set in accordance with, for example, an engine temperature state obtained from the cooling water temperature thw or the like. The readiness of the spraying of injected fuel varies in accordance with the engine temperature state. For example, the spraying of fuel deteriorates more greatly if the engine temperature is lower and therefore the temperature of the cylinder peripheral wall and the piston top surface on which spray of fuel impinges is lower. Therefore, if the predetermined revolution speed α is set to a relatively low revolution speed, an undesired event as described below is likely, for example, when the temperature of the engine 10 is very low. That is, it is likely that although the initial starting of the engine has not been appropriately accomplished, it will be inappropriately determined that the start of the engine has been accomplished. In such a case, the amount of intake air will be increased so that the spraying of injected fuel will deteriorate leading to a misfire. However, if the predetermined revolution speed α is variably set in accordance with the engine temperature state as mentioned above, it becomes possible to properly determine that the starting of the engine has been accomplished and to properly increase the engine revolution speed NE, independently of whether the engine temperature is high or low.

Although in the foregoing embodiments, it is determined that the start of the engine has been accomplished on the condition that the engine revolution speed NE is greater than the predetermined revolution speed α, the condition for the determination is arbitrary. That is, a parameter other than the engine revolution speed NE may also be used as a determination criterion.

In the foregoing embodiments, after it is determined that the start of the engine has been accomplished, the degree of opening of the throttle valve 16 is gradually increased in accordance with transition of the engine revolution speed NE. However, the degree of opening of the throttle valve 16 may also be gradually increased in accordance with a parameter that indicates an engine operation state other than the engine revolution speed NE, for example, the intake pipe negative pressure, the amount of intake air, etc. Such is modifications also allow the throttle valve 16 to be opened in a favorable manner that is suitable to the engine operation state, as in the case where the engine revolution speed NE is used.

Furthermore, after it is determined that the start of the engine has been accomplished, the degree of opening of the throttle valve 16 may also be gradually increased simply in accordance with the elapse of time. This modification also prevents a sharp increase in the amount of intake air caused by a change in the target degree of opening of the throttle valve 16 at the time of accomplishment of the initial starting of the engine, and curbs deterioration of the combustion state due to deterioration of the spraying of fuel, and therefore reduces engine revolution fluctuations.

The foregoing embodiments are described in conjunction with the internal combustion engine 10 equipped with the mechanical high-pressure fuel pump 21 that is driven by the engine to pressurize fuel to be injected. However, the above-described control of the degree of opening of the throttle valve 16 at the time of the initial starting of the engine is also applicable to internal combustion engines having a construction in which fuel to be injected is pressurized by a fuel pump other than the mechanical fuel pump.

In the illustrated embodiment, the controller (the ECU 30) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A throttle control apparatus for a direct-fuel-injection internal combustion engine in which fuel is injected directly into a cylinder, the throttle control apparatus comprising:

a throttle valve for adjusting an amount of intake air drawn into the cylinder; and a controller that when the engine is initially started, sets a degree of opening of the throttle valve to a degree of opening that is on a closed valve side of a post-engine start target degree of opening; and gradually increases the target degree of opening of the throttle valve to the post-engine start target degree of opening, and opens the throttle valve from the degree of opening of a closed valve state to the increased target degree of opening of the throttle valve, when it is determined that the start of the engine has been accomplished.

2. A throttle control apparatus according to claim 1, wherein the controller determines that the start of the engine has been accomplished, on a condition that an engine revolution speed has exceeded a predetermined revolution speed.

3. A throttle control apparatus according to claim 2, wherein the predetermined revolution speed is variably set in accordance with an engine temperature of the internal combustion engine.

4. A throttle control apparatus according to claim 2, wherein after a predetermined delay time and after it is determined that the start of the engine has been accomplished, the controller gradually increases the degree of opening of the throttle valve from the degree of opening of the closed valve state to the post-engine start target degree of opening.

5. A throttle control apparatus according to claim 1, wherein the controller, after the start of the engine has been accomplished, gradually increases the degree of opening of the throttle valve to open the throttle valve, by setting the target degree of opening of the throttle valve in accordance with a transition state of at least one of an intake pipe negative pressure, the amount of intake air, and an engine revolution speed.

6. A throttle control apparatus according to claim 1, wherein the direct-fuel-injection internal combustion engine is an internal combustion engine in which fuel to be injected is pressurized by a mechanical high-pressure fuel pump driven by the engine.

7. A throttle control method for a direct-fuel-injection internal combustion engine in which fuel is injected directly into a cylinder, the method controlling a degree of opening of a throttle valve for adjusting an amount of intake air drawn into the cylinder, the method comprising:

setting the degree of opening of the throttle valve, when starting of the engine is initiated, to the degree of opening that is on a closed valve side of a post-engine start target degree of opening; and increasing gradually the target degree of opening of the throttle valve to the post-engine start target degree of opening, and opening the throttle valve from the degree of opening of a closed valve state to the increased target degree of opening of the throttle valve, when it is determined that a start of the engine has been accomplished.

8. A throttle control method according to claim 7, wherein it is determined that the start of the engine has been accomplished, on a condition that an engine revolution speed has exceeded a predetermined revolution speed.

9. A throttle control method according to claim 8, wherein the predetermined revolution speed is variably set in accordance with an engine temperature of the internal combustion engine.

10. A throttle control method according to claim 8, wherein after a predetermined delay time and after it is determined that the start of the engine has been accomplished, the degree of opening of the throttle valve is gradually increased from the degree of opening of the closed valve state to the post-engine start target degree of opening.

11. A throttle control method according to claim 7, wherein the degree of opening of the throttle valve, after the start of the engine has been accomplished, is gradually increased to open the throttle valve, by setting the target degree of opening of the throttle valve in accordance with a transition state of at least one of an intake pipe negative pressure, the amount of intake air, and an engine revolution speed.

* * * * *